US011539152B2

(12) United States Patent
Huang et al.

(10) Patent No.: US 11,539,152 B2
(45) Date of Patent: Dec. 27, 2022

(54) ELECTRICAL CONNECTOR WITH BETTER ANTI-INTERFERENCE PERFORMANCE

(71) Applicant: DONGGUAN LUXSHARE TECHNOLOGIES CO., LTD, Dongguan (CN)

(72) Inventors: Bin Huang, Dongguan (CN); Rongzhe Guo, Dongguan (CN); Hongji Chen, Dongguan (CN); Huanhuan Shen, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 64 days.

(21) Appl. No.: 17/356,081

(22) Filed: Jun. 23, 2021

(65) Prior Publication Data

US 2022/0052469 A1 Feb. 17, 2022

(30) Foreign Application Priority Data

Aug. 11, 2020 (CN) ..... 202010800133.2

(51) Int. Cl.
*H01R 12/71* (2011.01)
*H01R 12/70* (2011.01)
(Continued)

(52) U.S. Cl.
CPC ..... *H01R 12/716* (2013.01); *H01R 12/7005* (2013.01); *H01R 13/518* (2013.01); *H01R 13/6471* (2013.01); *H01R 13/6583* (2013.01)

(58) Field of Classification Search
CPC ..... H01R 13/518; H01R 13/6461; H01R 13/6471; H01R 13/6583; H01R 13/6587;
(Continued)

(56) References Cited

U.S. PATENT DOCUMENTS 5,688,130 A * 11/1997 Huang ..... H01R 12/716 439/541.5
7,070,446 B2 7/2006 Henry et al.
(Continued)

FOREIGN PATENT DOCUMENTS

CN 202495593 U 10/2012
CN 207116790 U 3/2018
(Continued)

*Primary Examiner* — Marcus E Harcum
(74) *Attorney, Agent, or Firm* — Birch, Stewart, Kolasch & Birch, LLP

(57) ABSTRACT

An electrical connector includes an insulating body, a number of conductive terminals and a connection module. The insulating body includes a mating surface and a slot extending through the mating surface. The slot is adapted to receive at least a part of a mating connector along a mating direction. Each conductive terminal includes a tail portion and a contact portion extending into the slot. The connection module includes a mounting block and a number of connection terminals fixed with the mounting block. The connection terminals and the conductive terminals are disposed separately, thereby improving the anti-interference performance of the electrical connector. Each connection terminal includes an abutting portion to contact the tail portion of the conductive terminal and a mounting foot for being mounted to a circuit board.

18 Claims, 16 Drawing Sheets

(51) Int. Cl.
*H01R 13/518* (2006.01)
*H01R 13/6471* (2011.01)
*H01R 13/6583* (2011.01)

(58) Field of Classification Search
CPC ..... H01R 13/6691; H01R 31/06; H01R 12/7005; H01R 12/707; H01R 12/716; H01R 12/58; H01R 12/585
USPC ..... 439/108, 607.32
See application file for complete search history.

(56) References Cited

U.S. PATENT DOCUMENTS 7,753,742 B2 7/2010 Fedder et al.
7,775,802 B2 * 8/2010 Defibaugh ..... H01R 13/6587 439/607.1
7,967,637 B2 * 6/2011 Fedder ..... H01R 13/6587 439/607.06
8,187,035 B2 * 5/2012 Davis ..... H01R 13/6471 439/607.02
8,475,209 B1 * 7/2013 Whiteman, Jr. ..... H01R 12/724 439/607.07
8,535,065 B2 * 9/2013 Costello ..... H01R 31/06 439/82
9,666,961 B2 * 5/2017 Horning ..... H01R 13/6599
9,685,718 B1 * 6/2017 Wang ..... H01R 12/57
9,985,389 B1 * 5/2018 Morgan ..... H01R 13/6471
10,003,144 B1 * 6/2018 Sharf ..... H05K 1/0219
10,003,145 B1 * 6/2018 Annis ..... H01R 12/716
10,186,794 B2 * 1/2019 Regnier ..... H05K 1/144
10,276,984 B2 * 4/2019 Trout ..... H01R 13/6587
11,018,454 B2 * 5/2021 Laurx ..... H01R 13/518
11,444,398 B2 * 9/2022 Stokoe ..... H01R 12/716
2008/0176449 A1 * 7/2008 Hu ..... H01R 12/716 439/607.01
2010/0029105 A1 * 2/2010 Knaub ..... H01R 12/00 439/78
2015/0140865 A1 * 5/2015 Wickes ..... H01R 9/2408 439/715
2016/0072231 A1 * 3/2016 Sypolt ..... H01R 13/6585 439/607.08
2017/0133777 A1 * 5/2017 Little ..... H01R 12/721
2021/0203106 A1 * 7/2021 Hsiao ..... H01R 12/737

FOREIGN PATENT DOCUMENTS

CN 108987972 A 12/2018
CN 209592368 U 11/2019
CN 111082242 A 4/2020
TW M266593 U 6/2005
TW I523348 B 2/2016
TW M582249 U 8/2019
TW M589374 U 1/2020

* cited by examiner

ELECTRICAL CONNECTOR WITH BETTER ANTI-INTERFERENCE PERFORMANCE

CROSS-REFERENCE TO RELATED APPLICATION

This patent application claims priority of a Chinese Patent Application No. 202010800133.2, filed on Aug. 11, 2020 and titled "ELECTRICAL CONNECTOR", the entire content of which is incorporated herein by reference.

TECHNICAL FIELD

The present disclosure relates to an electrical connector, which belongs to a technical field of electrical connectors.

BACKGROUND

An electrical connector usually includes an insulating body and a plurality of conductive terminals fixed to the insulating body. The conductive terminal includes a contact portion for contacting with a mating connector and a mounting foot for being mounted to a circuit board. Connections between the mounting foot and the circuit board usually includes perforation soldering, surface soldering and press-fit etc. However, as electrical connectors have higher and higher requirements for signal transmission quality, how to solve the problem of signal interference at connection positions between the mounting feet of the conductive terminals and the circuit board is a technical challenge for those skilled in the art.

SUMMARY

An object of the present disclosure is to provide an electrical connector with better anti-interference performance.

In order to achieve the above object, the present disclosure adopts the following technical solution: an electrical connector including: an insulating body comprising a mating surface and a slot extending through the mating surface, the slot being adapted to receive at least a part of a mating connector along a mating direction; a plurality of conductive terminals, each conductive terminal comprising a tail portion and a contact portion extending into the slot; and a connection module comprising a mounting block and a plurality of connection terminals fixed with the mounting block, the connection terminals and the conductive terminals being disposed separately, each connection terminal comprising an abutting portion to contact the tail portion of the conductive terminal and a mounting foot for being mounted to a circuit board.

In order to achieve the above object, the present disclosure adopts the following technical solution: an electrical connector, including: an insulating body comprising a mating surface and a slot extending through the mating surface; a plurality of conductive terminals, each conductive terminal comprising a tail portion and a contact portion extending into the slot, the contact portion being adapted to mate with a mating connector; and a connection module comprising a mounting block and a plurality of connection terminals fixed with the mounting block, the connection terminals and the conductive terminals being arranged separately, each connection terminal comprising an abutting portion and a mounting foot for being mounted to a circuit board; wherein the abutting portion comprises a first abutting arm, a second abutting arm opposite to the first abutting arm, and a receiving slot located between the first abutting arm and the second abutting arm; the tail portion of the conductive terminal is received in the receiving slot so as to contact the abutting portion; wherein the abutting portion of the connection terminal and the tail portion of the conductive terminal are contact each other at a perpendicular angle.

Compared with the prior art, the present disclosure is provided with a connection module, and the connection module includes a plurality of connection terminals and a mounting block separately arranged from the conductive terminals, thereby improving the anti-interference performance of the electrical connector.

DETAILED DESCRIPTION

Figure 1:
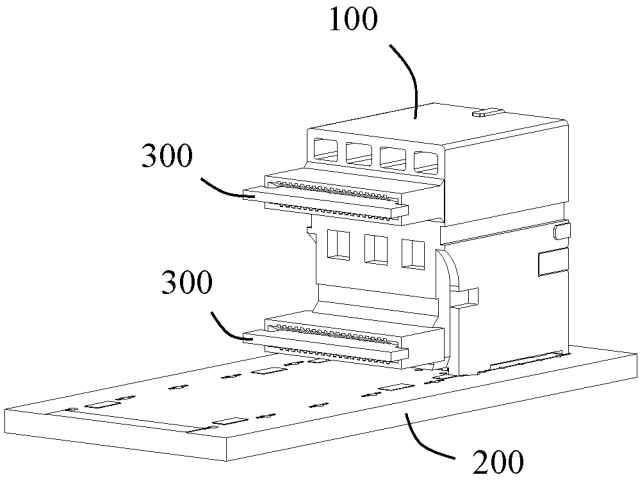
FIG. 1 is a perspective schematic view of an electrical connector when mounted on a circuit board and mated with a part of a mating connector, in accordance with an embodiment of the present disclosure.
Figure 2:
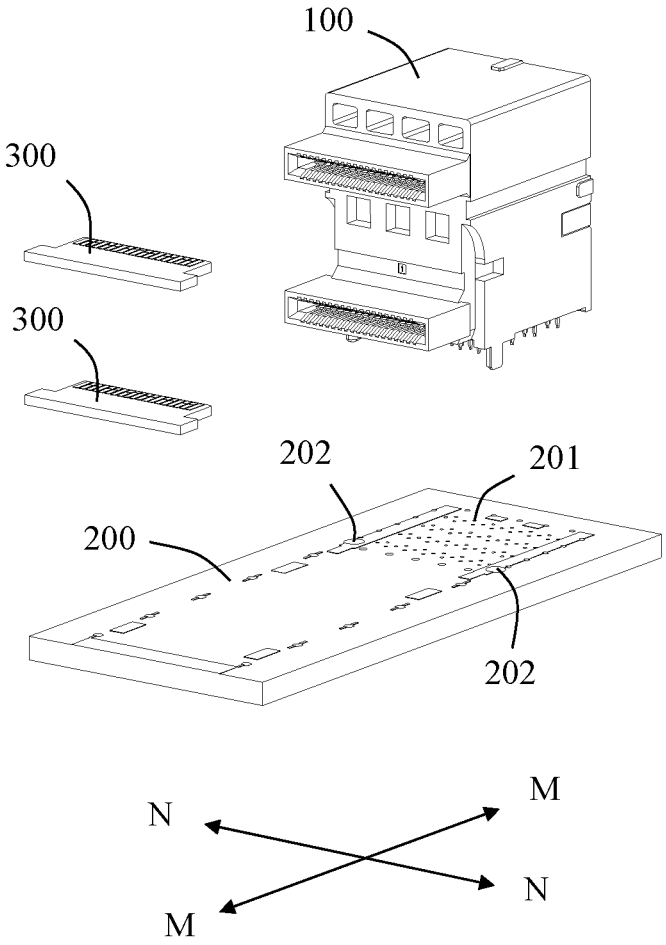
FIG. 2 is a partially exploded perspective view of FIG. 1.
Figure 3:
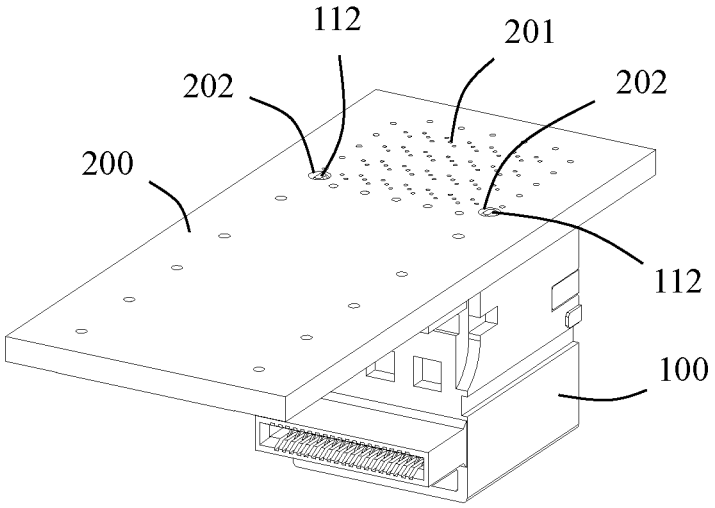
FIG. 3 is a perspective schematic view of FIG. 1 from another angle.
Figure 4:
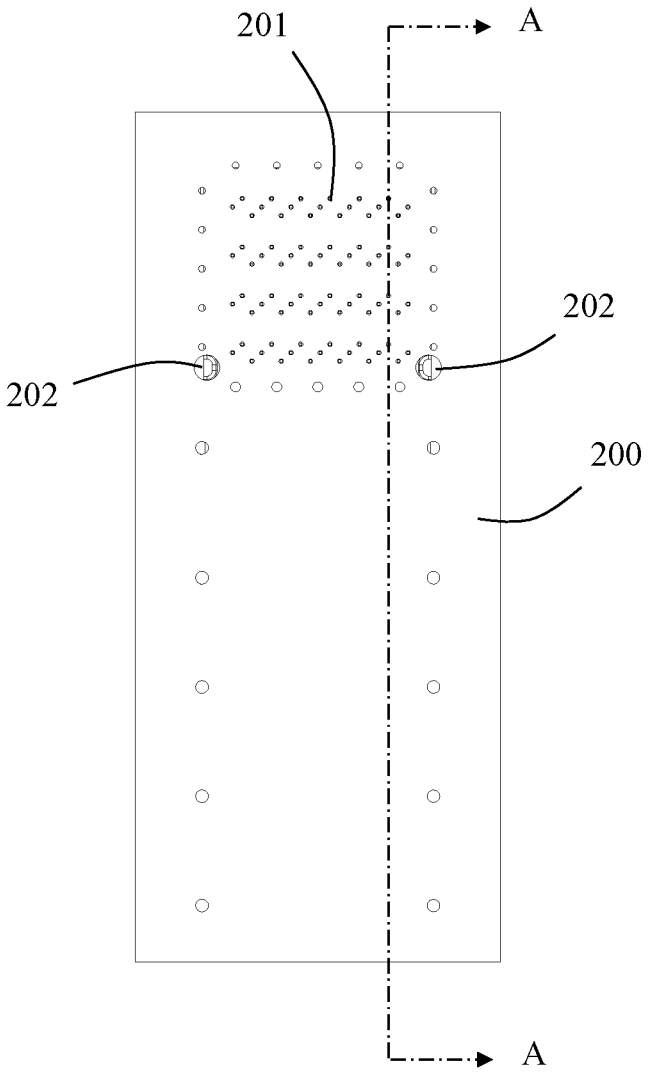
FIG. 4 is a top view of FIG. 3.
Figure 5:
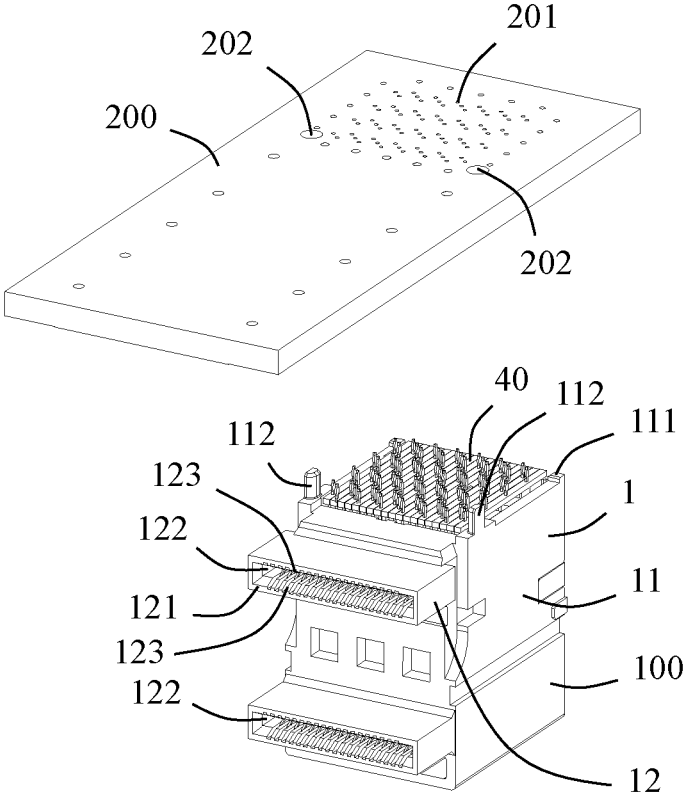
FIG. 5 is a perspective schematic view of the electrical connector of the present disclosure.
Figure 6:
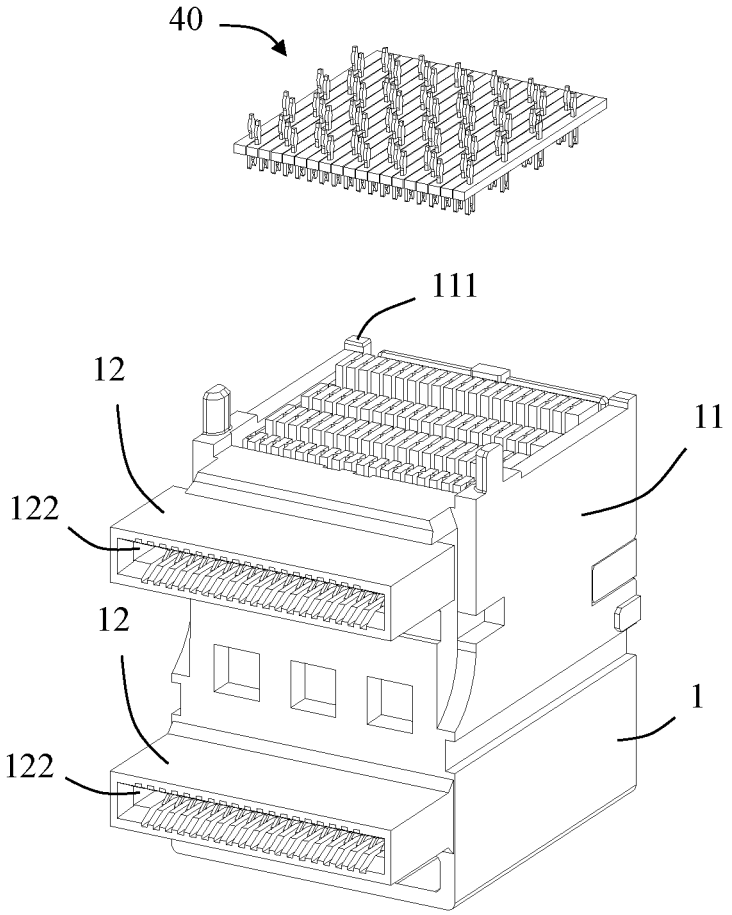
FIG. 6 is a partial perspective exploded view of FIG. 5, in which the connection module is separated.

Exemplary embodiments will be described in detail here, examples of which are shown in drawings. When referring to the drawings below, unless otherwise indicated, same numerals in different drawings represent the same or similar elements. The examples described in the following exemplary embodiments do not represent all embodiments consistent with this application. Rather, they are merely examples of devices and methods consistent with some aspects of the application as detailed in the appended claims.

The terminology used in this application is only for the purpose of describing particular embodiments, and is not intended to limit this application. The singular forms "a", "said", and "the" used in this application and the appended claims are also intended to include plural forms unless the context clearly indicates other meanings.

It should be understood that the terms "first", "second" and similar words used in the specification and claims of this application do not represent any order, quantity or importance, but are only used to distinguish different components. Similarly, "an" or "a" and other similar words do not mean a quantity limit, but mean that there is at least one; "multiple" or "a plurality of" means two or more than two. Unless otherwise noted, "front", "rear", "lower" and/or "upper" and similar words are for ease of description only and are not limited to one location or one spatial orientation. Similar words such as "include" or "comprise" mean that elements or objects appear before "include" or "comprise" cover elements or objects listed after "include" or "comprise" and their equivalents, and do not exclude other elements or objects. The term "a plurality of" mentioned in the present disclosure includes two or more.

Hereinafter, some embodiments of the present disclosure will be described in detail with reference to the accompanying drawings. In the case of no conflict, the following embodiments and features in the embodiments can be combined with each other.

Referring to FIGS. 1 to 4, the present disclosure discloses an electrical connector 100 for being mounted on a circuit board 200. In an illustrated embodiment of the present disclosure, the circuit board 200 includes a plurality of conductive holes 201 and a plurality of mounting holes 202.

Referring to FIGS. 5 to 8, the electrical connector 100 includes an insulating body 1 and a plurality of terminal modules 20 fixed to the insulating body 1 and a connection module 40 mating with the terminal modules 20. Of course, in some embodiments, the electrical connector 100 further includes a metal shell (not shown) shielded on the insulating body 1. The metal shell is roughly cylindrical so as to have a better shielding effect. The metal shell includes a top wall, a bottom wall, a first side wall, a second side wall, and a receiving cavity which is surrounded by the top wall, the bottom wall, the first side wall and the second side wall and used for receiving most portion of a mating connector. In some embodiments of the present disclosure, the electrical connector 100 is a high-speed connector, such as a QSFP connector, an SFP connector, an OSFP connector, or an OSFP-DD connector etc. Of course, in other embodiments, the electrical connector 100 may also be other types of connectors. In the illustrated embodiment of the present disclosure, the electrical connector 100 has a double-layer structure, which has two connector ports that are stacked and have the same structure. Unless otherwise specified, only one connector port is used as an example for description.

Specifically, the insulating body 1 includes a main body portion 11, a protruding portion 12 extending forwardly from the main body portion 11, and a rear cover 13 assembled at a rear end of the main body portion 11. The main body portion 11 includes a mounting surface 111 at a bottom and a plurality of mounting posts 112 protruding downwardly beyond the mounting surface 111. The mounting posts 112 are adapted to be inserted into the mounting holes 202 of the circuit board 200 in order to achieve positioning. In addition, a plurality of positioning grooves 113 are provided at the rear end of the main body portion 11. The protruding portion 12 includes a mating surface 121, a slot 122 extending through the mating surface 121, and receiving grooves 123 located on upper and lower sides of the slot 122. In the illustrated embodiment of the present disclosure, the slot 122 is adapted for receiving a part of the mating connector (for example, a tongue 300 of the mating connector, referring to FIGS. 1 and 2).

Referring to FIGS. 7 to 10, in the illustrated embodiment of the present disclosure, the terminal module 20 includes a plurality of conductive terminals 2 and an insulating block 3 fixed with the conductive terminals 2. The conductive terminals 2 can be insert-molded with the insulating block 3. Of course, in other embodiments, the conductive terminals 2 may also be fixed to the insulating block 3 by assembling. The conductive terminals 2 of each terminal module 20 are arranged in two rows.

Figure 9:
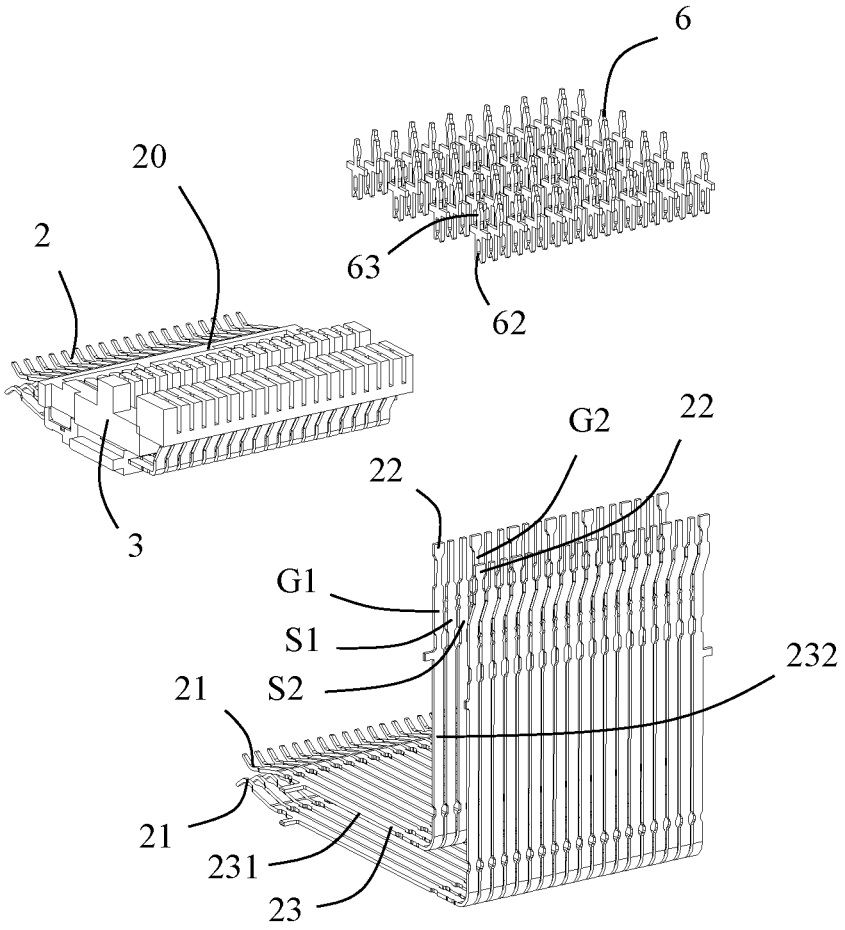
FIG. 9 is a perspective exploded view of parts of terminal modules and connection terminals.
Figure 10:
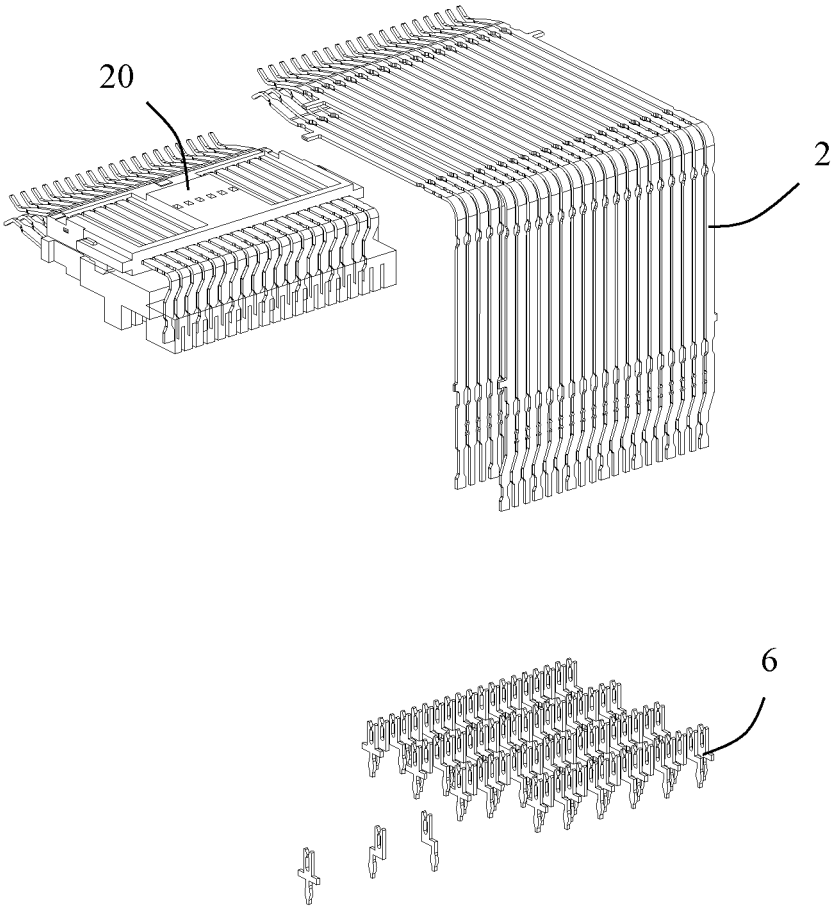
FIG. 10 is a perspective exploded view of FIG. 9 from another angle, in which a first ground connection terminal, a first signal connection terminal, a second signal connection terminal and a second ground connection terminal are separated.
Figure 11:
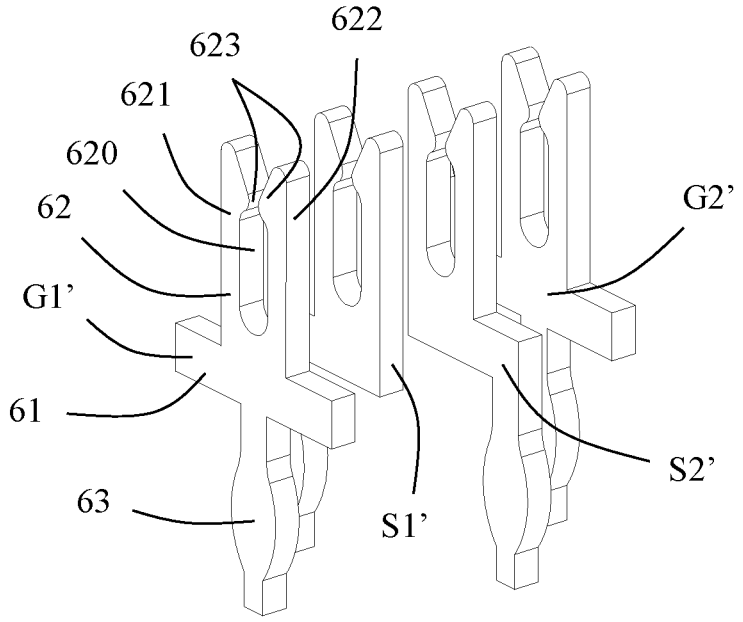
FIG. 11 is a perspective view of a group of the first ground connection terminal, the first signal connection terminal, the second signal connection terminal, and the second ground connection terminal in FIG. 10.
Figure 12:
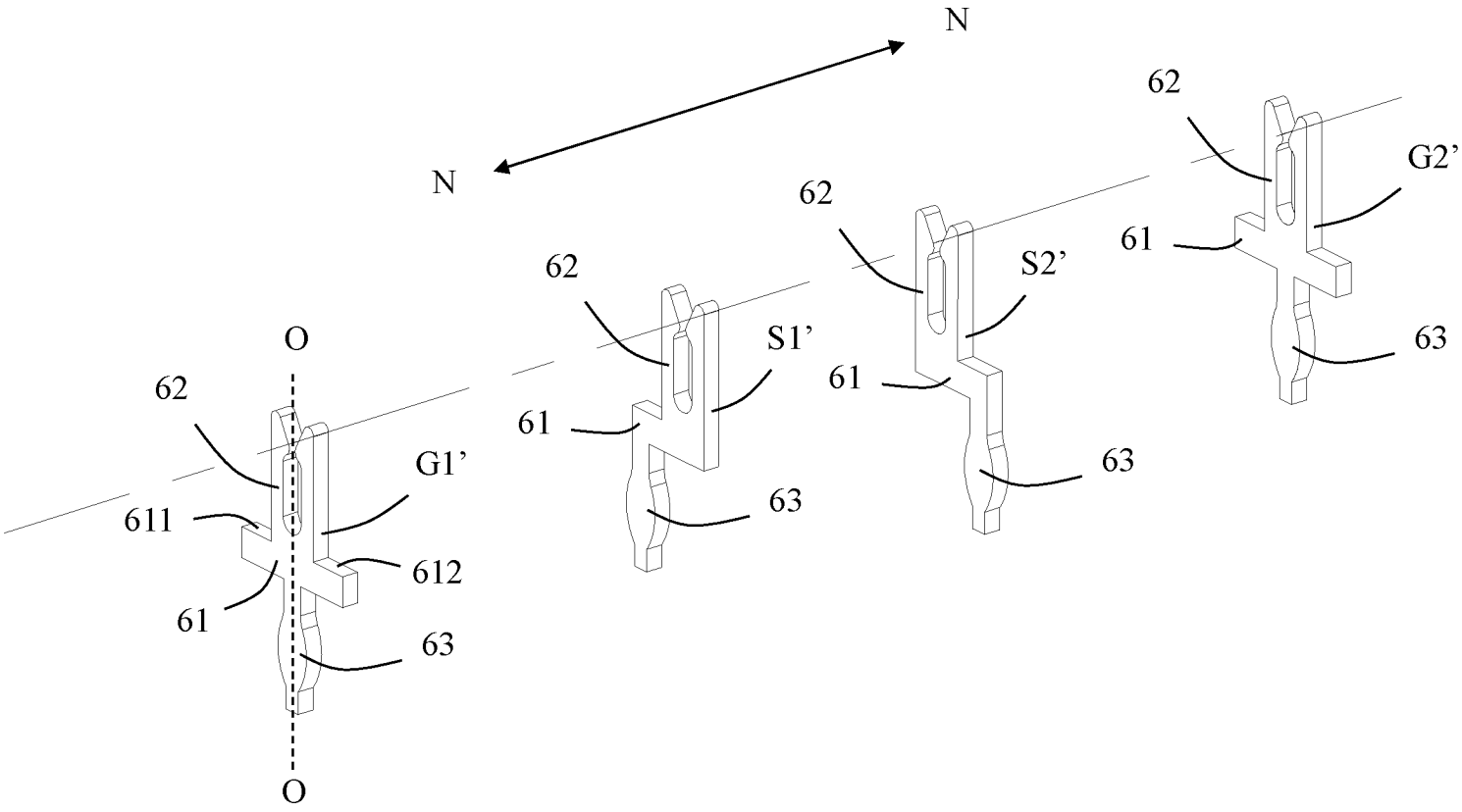
FIG. 12 is a perspective exploded view of FIG. 11.
Figure 13:
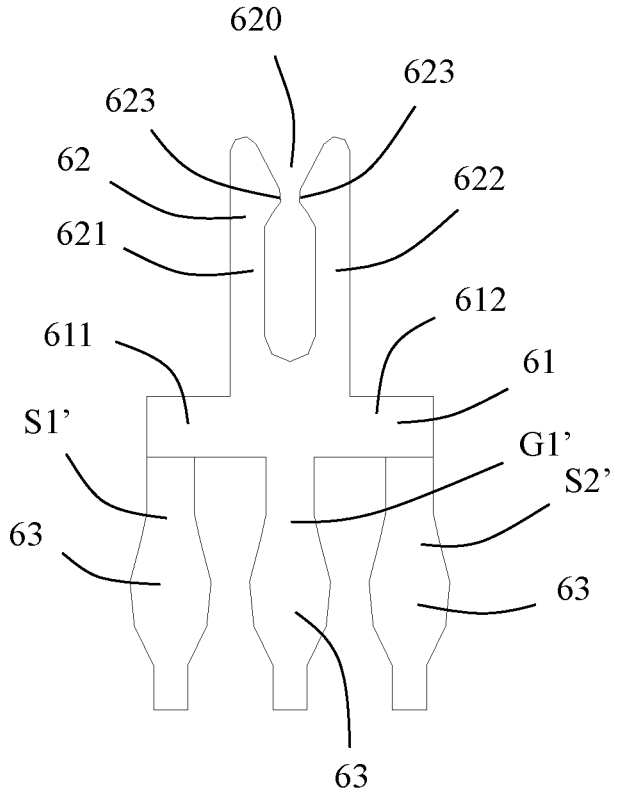
FIG. 13 is a left side view of FIG. 11.
Figure 14:
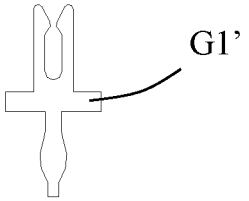
FIG. 14 is a front view of the first ground connection terminal.
Figure 15:
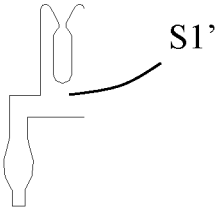
FIG. 15 is a front view of the first signal connection terminal.
Figure 16:
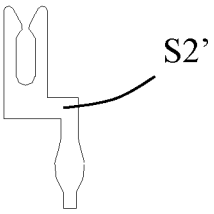
FIG. 16 is a front view of the second signal connection terminal.
Figure 17:
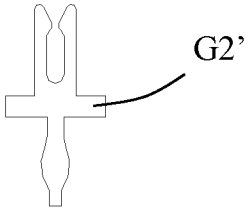
FIG. 17 is a front view of the second ground connection terminal.
Figure 18:
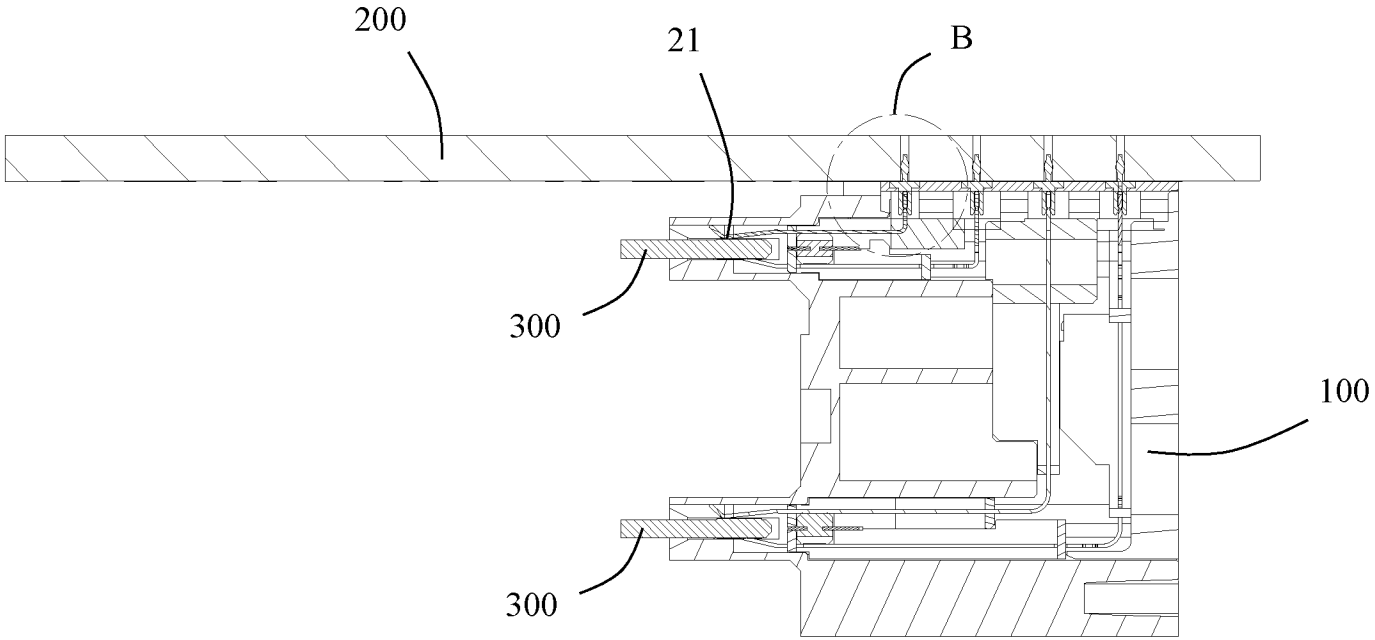
FIG. 18 is a schematic cross-sectional view taken along line A-A in FIG. 4.

Referring to FIG. 9, from a functional point of view, each row of conductive terminals 2 include a plurality of first ground terminals G1, a plurality of first signal terminals S1, a plurality of second signal terminals S2, and a plurality of second ground terminals G2. The first signal terminal S1 and the second signal terminal S2, which are adjacent to each other, form a group of differential signal terminals. Two sides of each group of differential signal terminals are respectively one first ground terminal G1 and one second ground terminal G2 so as to form a layout of G-S-S-G. This terminal layout is beneficial to improve the speed and quality of signal transmission.

From a structural point of view, each conductive terminal 2 includes an elastic contact portion 21 positioned in the receiving groove 123 and protruding into the slot 122, a tail portion 22 extending towards the mounting surface 111 and a connection portion 23 connecting the elastic contact portion 21 and the tail portion 22. In the illustrated embodiment of the present disclosure, the conductive terminal 2 is substantially L-shaped. An extending direction of the elastic contact portion 21 is perpendicular to an extending direction of the tail portion 22. The connection portion 23 is bent. Specifically, the connection portion 23 is substantially L-shaped and includes a first extension portion 231 connected to the elastic contact portion 21 and a second extension portion 232 connected to the tail portion 22. The elastic contact portion 21 is adapted for contacting with the mating connector. As far as one connector port is concerned, the elastic contact portions 21 located in the slot 122 are disposed in two rows along a vertical direction, and the two rows of the elastic contact portions 21 jointly clamp a part of the mating connector. The receiving cavity of the metal shell is in communication with the slot 122. The receiving cavity is located at a front end of the slot 122. The slot 122 and the receiving cavity are used for accommodating the mating connector along a mating direction M-M (referring to FIG. 2).

Figure 7:
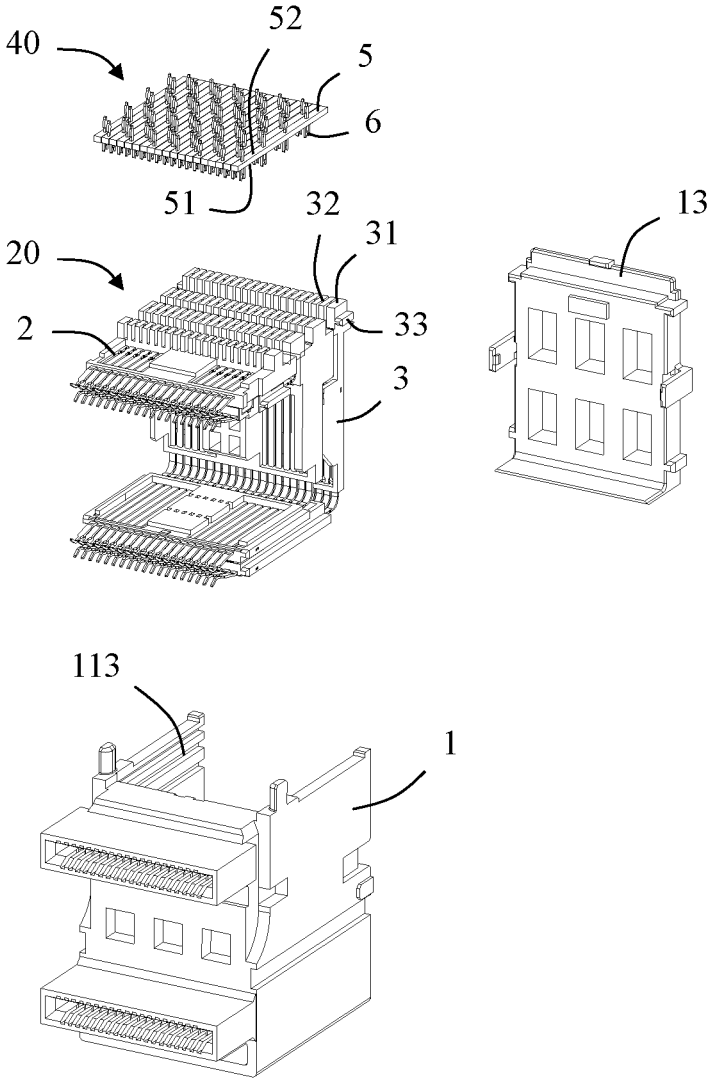
FIG. 7 is a further perspective exploded view of FIG. 6.
Figure 8:
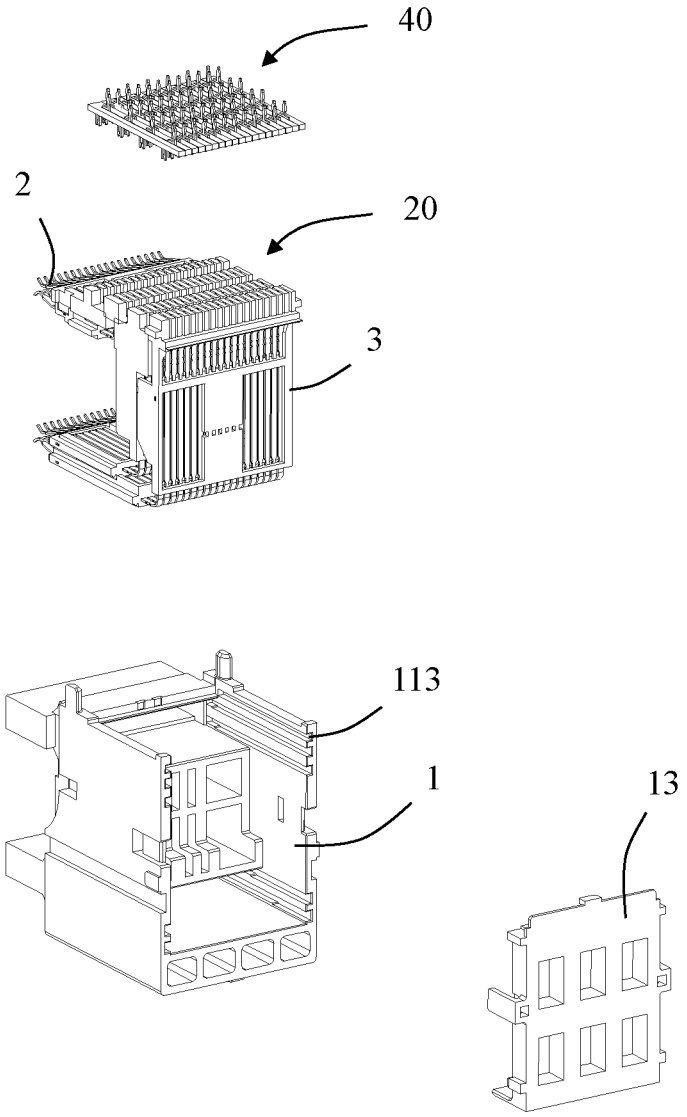
FIG. 8 is a perspective exploded view of FIG. 7 from another angle.

Referring to FIG. 7, in the illustrated embodiment of the present disclosure, the insulating block 3 includes a bottom surface 31 and a plurality of slits 32 extending through the bottom surface 31. The tail portions 22 of the conductive terminals 2 extend into the slits 32 in a cantilevered way. In the illustrated embodiment of the present disclosure, the tail portions 22 are completely located in the slits 32, that is, the tail portions 22 do not extend beyond the bottom surface 31. This arrangement can protect the tail portions 22 of the conductive terminals 2 and reduce the risk of deformation due to external force. In addition, the insulating block 3 also includes a plurality of positioning ribs 33 for mating with the positioning grooves 113.

Referring to FIG. 7, the connection module 40 includes a mounting block 5 and a plurality of connection terminals 6 fixed to the mounting block 5. The mounting block 5 is made of insulating material. In an embodiment of the present disclosure, the connection terminals 6 are insert-molded with the mounting block 5. Of course, in other embodiments, the connection terminals 6 may also be fixed to the mounting block 5 by means of assembling or the like. The mounting block 5 has an upper surface 51 and a lower surface 52.

Referring to FIGS. 11 to 17, from a functional point of view, the connection terminal 6 includes a first ground connection terminal G1' in contact with the first ground terminal G1, a first signal connection terminal S1' in contact with the first signal terminal S1, a second signal connection terminal S2' in contact with the second signal terminal S2, and a second ground connection terminal G2' in contact with the second ground terminal G2.

From a structural point of view, the connection terminal 6 includes a fixing portion 61 fixed to the mounting block 5, an abutting portion 62 extending upwardly from the fixing portion 61, and a mounting foot 63 extending downwardly from the fixing portion 61. In other words, the abutting portion 62 and the mounting foot 63 are respectively connected to two ends (for example, an upper end and a lower end) of the fixing portion 61. The abutting portions 62 are adapted to contact the tail portions 22 of the conductive terminals 2. The mounting feet 63 are adapted to be inserted into the conductive holes 201 of the circuit board 200 so as to realize electrical connection with the circuit board 200. In other embodiments, each mounting foot 63 can also be provided with an oval fisheye hole, so that the mounting foot 63 has a certain elastic deformation ability, which is advantageous for being inserted into the conductive hole 201 of the circuit board 200.

In the illustrated embodiment of the present disclosure, each fixing portion 61 of the first ground connection terminal G1' and the second ground connection terminal G2' further includes a first wing portion 611 and the second wing portion 612 protruding respectively from two sides (for example, a left side and a right side in FIG. 12) thereof, so that the first ground connection terminal G1' and the second ground connection terminal G2' are of cross-shaped configurations. Specifically, the first wing portion 611 protrudes beyond the abutting portion 62 and the mounting foot 63 of the corresponding first ground connection terminal G1' and the corresponding second ground connection terminal G2' along a first side (for example, the left side in FIG. 12). The second wing portion 612 protrudes beyond the abutting portion 62 and the mounting foot 63 of the corresponding first ground connection terminal G1' and the corresponding second ground connection terminal G2' along a second side (for example, the right side in FIG. 12) opposite to the first side. In the illustrated embodiment of the present disclosure, the first wing portion 611 and the second wing portion 612 both extend in a horizontal direction and have the same length. The abutting portion 62 and the mounting foot 63 of each of the first signal connection terminal S1' and the second signal connection terminal S2' are respectively connected with two ends (for example, an upper end and a lower end) of the corresponding fixing portion 61, so that the first signal connection terminal S1' and the second signal connection terminal S2' are of stepped configurations. Specifically, in the illustrated embodiment of the present disclosure, the fixing portions 61 of the first signal connection terminal S1' and the second signal connection terminal S2' extend in the horizontal direction. The first side (for example, the left side in FIG. 12) of the fixing portion 61 of the first signal connection terminal S1' does not protrude beyond the mounting foot 63 of the first signal connection terminal S1'. The second side (for example, the right side in FIG. 12) of the fixing portion 61 of the first signal connection terminal S1' does not protrude beyond the abutting portion 62 of the first signal connection terminal S1'. Specifically, the second side (for example, the right side in FIG. 12) of the fixing portion 61 of the first signal connection terminal S1' is aligned with the right side of the abutting portion 62 of the first signal connection terminal S1' along the vertical direction. The first side (for example, the left side in FIG. 12) of the fixing portion 61 of the second signal connection terminal S2' does not protrude beyond the abutting portion 62 of the second signal connection terminal S2'. The second side (for example, the right side in FIG. 12) of the fixing portion 61 of the second signal connection terminal S2' does not protrude beyond the mounting foot 63 of the second signal connection terminal S2'. Specifically, the first side (for example, the left side in FIG. 12) of the fixing portion 61 of the second signal connection terminal S2' is aligned with the left side of the abutting portion 62 of the second signal connection terminal S2' in the vertical direction. In the illustrated embodiment of the present disclosure, the abutting portion 62 is bifurcated and includes a first abutting arm 621, a second abutting arm 622 opposite to the first abutting arm 621, and a receiving slot 620 located between the first abutting arm 21 and the second abutting arm 622. The first abutting arm 621 and/or the second abutting arm 622 includes a protrusion 623 which is in contact with the tail portion 22 of the conductive terminal 2. A plane on which a wide surface of the tail portion 22 is located is perpendicular to a plane on which a wide surface of the abutting portion 62 is located. Of course, in other embodiments, the abutting portion 62 may also have other shapes, as long as it can be reliably contacted with the tail portion 22 of the conductive terminal 2.

The abutting portion 62 of the first ground connection terminal G1', the abutting portion 62 of the first signal connection terminal S1', the abutting portion 62 of the second signal connection terminal S2' and the abutting portions 62 of the second ground connection terminal G2' are aligned along a width direction N-N perpendicular to the mating direction M-M. Preferably, a width of each fixing portion 61 of the first ground connection terminal G1' and the second ground connection terminal G2' is larger than a width of the fixing portion 61 of the first signal connection terminal S1' and is larger than a width of the fixing portion 61 of the second signal connection terminal S2', so that the shielding effect and the quality of signal transmission are improved.

In addition, the mounting foot 63 of the first ground connection terminal G1', the mounting foot 63 of the first signal connection terminal S1', and the mounting foot 63 of the second signal connection terminal S2' are staggered along the width direction N-N. By such setting, it is beneficial to reduce the crosstalk among the terminals and improve the quality of signal transmission. When viewed from the width direction N-N, the mounting foot 63 of the first ground connection terminal G1' is aligned with the mounting foot 63 of the second ground connection terminal G2'. The mounting foot 63 of the first ground connection terminal G1' and the mounting foot 63 of the second ground connection terminal G2' are located between the mounting foot 63 of the first signal connection terminal S1' and the mounting foot 63 of the second signal connection terminal G2'. When viewed from the width direction N-N, the first signal connection terminal S1' and the second signal connection terminal S2' are arranged in a mirror image along a central axis O-O of the mounting foot 63 of the first ground connection terminal G1'. With this arrangement, the first signal connection terminal S1' and the second signal connection terminal S2' can be shared, thereby reducing cost.

Figure 19:
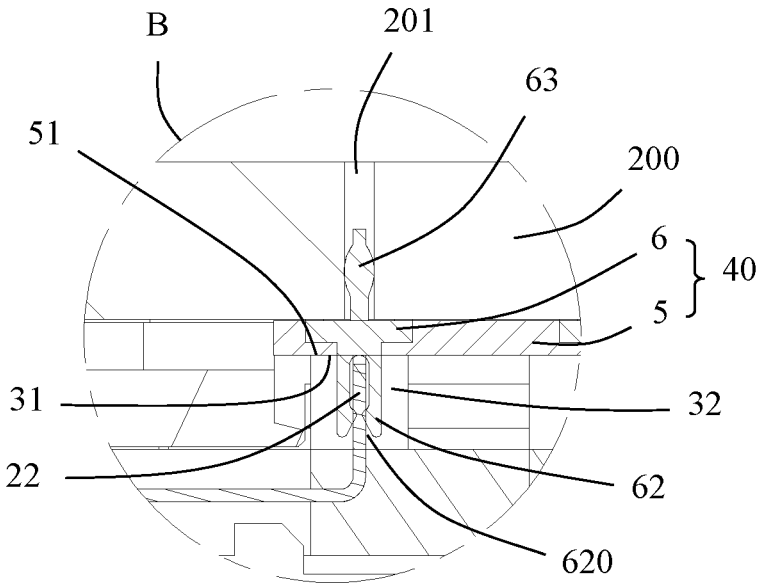
FIG. 19 is a partial enlarged view of a circled portion B in FIG. 18.

Referring to FIG. 19, when the connection module 40 is assembled to the bottom of the insulating body 1, the upper surface 51 of the mounting block 5 is in contact with the bottom surface 31 of the insulating block 3 so as to achieve assembly positioning. The abutting portions 62 are inserted into the slits 32, and the tail portions 22 of the conductive terminals 2 are received in the corresponding receiving slots 620.

Compared with the prior art, the present disclosure includes the connection module 40, and the connection module 40 includes the mounting block 5 and the plurality of connection terminals 6 separately arranged from the conductive terminals 2, thereby improving the anti-interference performance of the electrical connector 100. In addition, since the conductive terminals 2 and the connection terminals 6 are arranged separately, the conductive terminals 2 and the connection terminals 6 can be made of different materials, thereby improving the flexibility of realizing impedance matching.

The above embodiments are only used to illustrate the present disclosure and not to limit the technical solutions described in the present disclosure. The understanding of this specification should be based on those skilled in the art. Descriptions of directions, although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. An electrical connector, comprising: an insulating body comprising a mating surface and a slot extending through the mating surface, the slot being adapted to receive at least a part of a mating connector along a mating direction; a plurality of conductive terminals, each conductive terminal comprising a tail portion and a contact portion extending into the slot; and a connection module comprising a mounting block and a plurality of connection terminals fixed with the mounting block, the connection terminals and the conductive terminals being arranged separately, each connection terminal comprising an abutting portion to contact the tail portion of the conductive terminal and a mounting foot for being mounted to a circuit board; wherein each abutting portion is bifurcated and comprises a first abutting arm, a second abutting arm opposite to the first abutting arm, and a receiving slot located between the first abutting arm and the second abutting arm; and the tail.

2. The electrical connector according to claim 1, wherein the first abutting arm and/or the second abutting arm comprises a protrusion in contact with the tail portion of the conductive terminal.

3. The electrical connector according to claim 1, further comprising an insulating block, the conductive terminals being insert-molded with the insulating block, the insulating block comprising a bottom surface and a plurality of slits extending through the bottom surface, the tail portions of the conductive terminals extending into the slits, and the abutting portions being inserted into the slits.

4. The electrical connector according to claim 3, wherein the mounting block comprises an upper surface which is in contact with the bottom surface of the insulating block.

5. The electrical connector according to claim 1, wherein a plane on which a wide surface of the tail portion is located is perpendicular to a plane on which a wide surface of the abutting portion is located.

6. The electrical connector according to claim 1, wherein the conductive terminals comprise a first ground terminal, a first signal terminal, a second signal terminal and a second ground terminal which are disposed adjacently; wherein the first signal terminal and the second signal terminal are located between the first ground terminal and the second ground terminal; wherein the connection terminals comprise a first ground connection terminal in contact with the first ground terminal, a first signal connection terminal in contact with the first signal terminal, a second signal connection terminal in contact with the second signal terminal, and a second ground connection terminal in contact with the second ground terminal; wherein the abutting portion of the first ground connection terminal, the abutting portion of the first signal connection terminal, the abutting portion of the second signal connection terminal and the abutting portion of the second ground connection terminal are aligned with one another along a width direction perpendicular to the mating direction.

7. The electrical connector according to claim 6, wherein the mounting foot of the first ground connection terminal, the mounting foot of the first signal connection terminal and the mounting foot of the second signal connection terminal are staggered along the width direction.

8. The electrical connector according to claim 7, wherein when viewed along the width direction, the mounting foot of the first ground connection terminal is aligned with the mounting foot of the second ground connection terminal, and the mounting foot of the first ground connection terminal and the mounting foot of the second ground connection terminal are located between the mounting foot of the first signal connection terminal and the mounting foot of the second signal connection terminal.

9. The electrical connector according to claim 6, wherein when viewed along the width direction, the first signal connection terminal and the second signal connection terminal are arranged in a mirror image along a central axis of the mounting foot of the first ground connection terminal.

10. The electrical connector according to claim 6, wherein each of the first ground connection terminal and the second ground connection terminal comprises a fixing portion fixed to the mounting block; each fixing portion of the first ground connection terminal and the second ground connection terminal comprises a first wing portion and a second wing portion protruding sidewardly and along opposite directions beyond the abutting portion and the mounting foot thereof, so that the first ground connection terminal and the second ground connection terminal are of cross-shaped configurations; and wherein the abutting portions and the mounting feet of the first signal connection terminal and the second signal connection terminal are respectively connected to two ends of the fixing portions of the first ground connection terminal and the second ground connection terminal, so that the first signal connection terminal and the second signal connection terminal are of stepped configurations.

11. An electrical connector, comprising: an insulating body comprising a mating surface and a slot extending through the mating surface; a plurality of conductive terminals, each conductive terminal comprising a tail portion and a contact portion extending into the slot, the contact portion being adapted to mate with a mating connector; and a connection module comprising a mounting block and a plurality of connection terminals fixed with the mounting block, the connection terminals and the conductive terminals being arranged separately, each connection terminal comprising an abutting portion and a mounting foot for being mounted to a circuit board; wherein the abutting portion comprises a first abutting arm, a second abutting arm opposite to the first abutting arm, and a receiving slot located between the first abutting arm and the second abutting arm; the tail portion of the conductive terminal is received in the receiving slot so as to contact the abutting portion; and wherein the abutting portion of the connection terminal and the tail portion of the conductive terminal are contact each other at a perpendicular angle; wherein the first abutting arm and/or the second abutting arm comprises a protrusion in contact with the tail portion of the conductive terminal.

12. The electrical connector according to claim 11, further comprising an insulating block, the conductive terminals being insert-molded with the insulating block, the insulating block comprising a bottom surface and a plurality of slits extending through the bottom surface, the tail portions of the conductive terminals extending into the slits, and the abutting portions being inserted into the slits.

13. The electrical connector according to claim 12, wherein the mounting block comprises an upper surface which is in contact with the bottom surface of the insulating block.

14. The electrical connector according to claim 11, wherein a plane on which a wide surface of the tail portion is located is perpendicular to a plane on which a wide surface of the abutting portion is located.

15. The electrical connector according to claim 11, wherein the conductive terminals comprise a first ground terminal, a first signal terminal, a second signal terminal and a second ground terminal which are disposed adjacently; wherein the first signal terminal and the second signal terminal are located between the first ground terminal and the second ground terminal; wherein the connection terminals comprise a first ground connection terminal in contact with the first ground terminal, a first signal connection terminal in contact with the first signal terminal, a second signal connection terminal in contact with the second signal terminal, and a second ground connection terminal in contact with the second ground terminal; wherein the abutting portion of the first ground connection terminal, the abutting portion of the first signal connection terminal, the abutting portion of the second signal connection terminal and the abutting portion of the second ground connection terminal are aligned with one another along a width direction perpendicular to the mating direction.

16. The electrical connector according to claim 15, wherein the mounting foot of the first ground connection terminal, the mounting foot of the first signal connection terminal and the mounting foot of the second signal connection terminal are staggered along the width direction.

17. The electrical connector according to claim 16, wherein when viewed along the width direction, the mounting foot of the first ground connection terminal is aligned with the mounting foot of the second ground connection terminal, and the mounting foot of the first ground connection terminal and the mounting foot of the second ground connection terminal are located between the mounting foot of the first signal connection terminal and the mounting foot of the second signal connection terminal.

18. The electrical connector according to claim 15, wherein when viewed along the width direction, the first signal connection terminal and the second signal connection terminal are arranged in a mirror image along a central axis of the mounting foot of the first ground connection terminal.

* * * * *